US007552878B2

(12) United States Patent
Jäger

(10) Patent No.: US 7,552,878 B2
(45) Date of Patent: Jun. 30, 2009

(54) ROTORDUSE

(76) Inventor: Anton Jäger, Hofackergrasse 3, Senden (DE) D-89250

( * ) Notice: Subject to any disclaimer, the term of this patent is extended or adjusted under 35 U.S.C. 154(b) by 169 days.

(21) Appl. No.: 11/739,852

(22) Filed: Apr. 25, 2007

(65) Prior Publication Data

US 2008/0035755 A1 Feb. 14, 2008

(30) Foreign Application Priority Data

Apr. 25, 2006 (DE) ..... 10 2006 019 078

(51) Int. Cl.
*B05B 3/16* (2006.01)
*B05B 3/04* (2006.01)

(52) U.S. Cl. ..... 239/381; 239/225.1; 239/380; 239/383; 239/382; 239/237

(58) Field of Classification Search ..... 239/380–383, 239/240, 263, 264, 251, 252, 256
See application file for complete search history.

(56) References Cited

U.S. PATENT DOCUMENTS

| | | | | |
|---|---|---|---|---|
| 5,598,975 | A * | 2/1997 | Jager | 239/237 |
| 5,722,592 | A * | 3/1998 | Jager | 239/227 |
| 6,250,566 | B1 * | 6/2001 | Jager | 239/237 |
| 6,755,358 | B2 * | 6/2004 | Jaeger | 239/381 |
| 7,118,051 | B1 * | 10/2006 | Jager | 239/381 |

FOREIGN PATENT DOCUMENTS

| | | |
|---|---|---|
| DE | 4013446 | 5/1991 |
| DE | 4133973 | 4/1992 |
| DE | 4319743 | 12/1994 |
| DE | 19832568 | 1/2000 |
| DE | 102004022588 | 12/2005 |

* cited by examiner

*Primary Examiner*—Len Tran
*Assistant Examiner*—James S Hogan
(74) *Attorney, Agent, or Firm*—Gifford, Krass, Sprinkle, Anderson & Citkowski, P.C.

(57) ABSTRACT

The invention relates to a rotor nozzle, in particular for high pressure cleaning devices, having a nozzle housing which has a swirl chamber between an inflow opening for a fluid, in particular water, and a discharge opening, with a rotor inclined with respect to a longitudinal axis during operation being supported at its front end at a bearing, in particular at a cup-shaped bearing, in said swirl chamber and with the rotor being able to be driven to make a rotating movement around the longitudinal axis by fluid flowing into the swirl chamber, wherein an adjustment device is positioned in front of the swirl chamber for the speed regulation of the rotor and forces the inflowing fluid to make a rotary movement around the longitudinal axis for the generation of a rotating fluid field before the transition into the swirl chamber, and wherein the rotating fluid field is disrupted more or less pronouncedly on the transition into the swirl chamber in dependence on the position of the adjustment device.

8 Claims, 6 Drawing Sheets

ROTORDUSE

CROSS-REFERENCE TO RELATED APPLICATIONS

This application claims priority of German Patent Application No. 10 2006 019 078.5 filed Apr. 25, 2006.

FIELD OF THE INVENTION

The invention relates to a rotor nozzle, in particular for high pressure cleaning devices, having the features of the preamble of claim 1.

SUMMARY OF THE INVENTION

Rotor nozzles of this type are generally known.

It is the object of the invention to further develop a rotor nozzle of the initially named kind such that the speed of the rotor can be regulated in a simple and reliable manner as precisely as possible.

The object is satisfied by the features of claim 1.

The invention is based on the idea of generating a rotating fluid field before the transition to the swirl chamber and then to disrupt this rotating fluid field more or less pronouncedly on the transition into the swirl chamber. Depending on the position of the adjustment device, the rotating fluid field can thus propagate more or less unimpeded into the swirl chamber and can provide for the taking along of the rotor in the swirl chamber to drive it to make the rotating movement around the longitudinal axis.

The invention thus, on the one hand, represents a turning away from those conventional rotor nozzles in which the rotating fluid field is only generated in the swirl chamber. On the other hand, the invention represents a turning away from known methods for speed regulation in which a so-called splitting of the inflowing fluid amount takes place in that some of the fluid is guided to the discharge opening while bypassing the swirl chamber with the help of bypass devices. It is, in contrast, not necessary due to the principle of the swirl field or rotating field disruption in accordance with the invention to guide some of the fluid past the swirl chamber by means of bypass devices. It is rather preferred in accordance with the invention for the fluid amount flowing into the swirl chamber per time unit to be constant, i.e. the invention does not work according to the principle of "amount splitting."

Furthermore, it is of advantage in accordance with the invention for no pressure difference to arise on the transition into the swirl chamber. Independently of how much the rotating fluid field is disrupted on the transition into the swirl chamber, the flow cross-sections at the transition can be dimensioned overall such that the fluid forming the rotating field does not have to overcome any resistance resulting in a pressure difference on the transition into the swirl chamber.

Further preferred embodiments of the invention can be seen from the dependent claims, from the description and from the drawing.

BRIEF DESCRIPTION OF THE DRAWINGS

The invention will be described in the following by way of example with reference to the drawing. There are shown.

DETAILED DESCRIPTION OF THE PREFERRED EMBODIMENTS

Figure 1A:
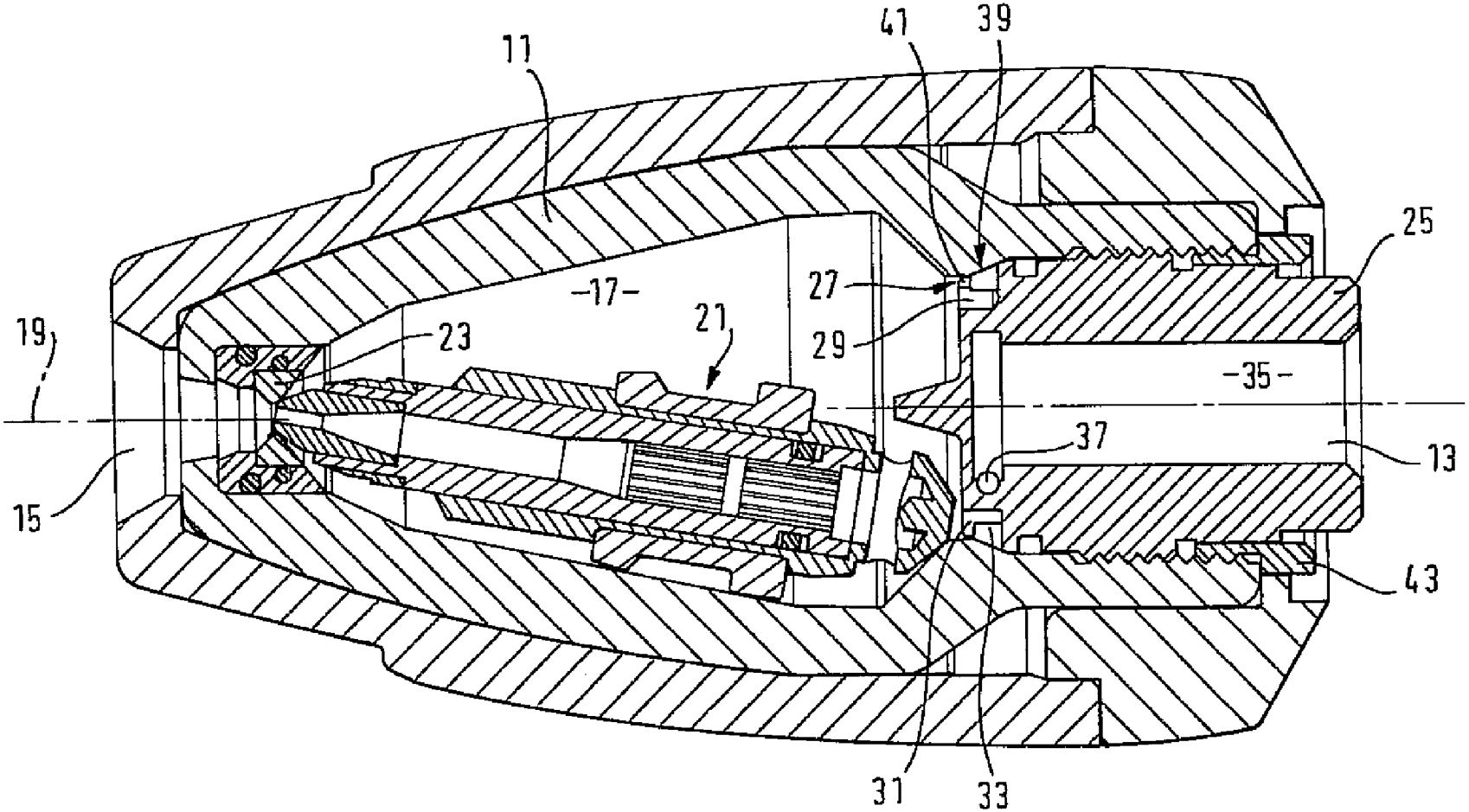
FIGS. 1*a* and 1*b* an embodiment of a rotor nozzle in accordance with the invention in two different operating positions.

The rotor nozzles described in the following correspond to conventional rotor nozzles with respect to their general design so that a detailed description can be dispensed with in this respect.

A cylindrical or pin-shaped rotor 21, which is supported in a cup bearing 23 at its front end, is arranged in a nozzle housing 11 with a longitudinal axis 19. A stopper 25 is screwed into the rear end of the nozzle housing 11. The stopper 25 forms an adjustment device in accordance with the invention, which will be looked at in more detail in the following.

The basic principle of such a rotor nozzle lies in the fact of driving the rotor 21 inclined with respect to the longitudinal axis 19 in the swirl chamber 17 to make a rotating movement around the longitudinal axis 19 in order to expel a conical fluid jet via the discharge opening 15 in this manner. For this purpose, a swirl flow or a rotating fluid field is generated in the swirl chamber 17 and provides a corresponding taking along of the rotor 21. The fluid located in the swirl chamber 17 enters the rotor, for example, at the rear end of the rotor 21 and flows through the rotor 21 to the discharge opening 15 to there be expelled as a conical jet under high pressure.

With conventional rotor nozzles, a drive bore opening radially or tangentially into the swirl chamber 17 is provided at the stopper 25, for example, via which drive bore the fluid flows in the swirl chamber 17 such that the mentioned swirl flow arises into the swirl chamber 17.

In the embodiments of a rotor nozzle in accordance with the invention described here, the swirl flow or the rotating fluid field is not first generated in the swirl chamber 17, but before the transition of the fluid from the stopper 25 into the swirl chamber 17, and indeed at the stopper 25. For this purpose, a ring passage 33 is provided which is bounded by a ring groove formed in the stopper 25 and the inner wall of the nozzle housing 11, with the inner wall of the nozzle housing and the stopper 25 having a special cam section 39, 41 in this region which will be looked at in more detail in the following.

The fluid enters into the ring passage 33 via an inflow space 35 formed in the stopper 25. The fluid enters into the inflow space 35 via a supply line which is not shown and to which the rotor nozzle is connected during operation. The fluid supply line is in turn connected to a fluid source, in particular to a high pressure cleaning device.

The inflow space 35 is in communication with the ring passage 33 via a drive bore 37 which opens, in particular radially or tangentially, into the ring passage 33 so that the fluid in the ring passage 33 is forced to make a rotating movement around the longitudinal axis 19, whereby a rotating fluid field is generated. The rotating fluid field is therefore generated at the stopper 25 and not in the swirl chamber 17.

The screw-in depth of the stopper 25 into the rear end of the nozzle housing 11 can be set steplessly by screwing the stopper 25 in or out. A ring-shaped screw-in part 43 whose axial position is not varied relative to the nozzle housing 11 during operation serves as the rear abutment for the stopper 25. A defined axial adjustment path is provided for the stopper 25 in this manner.

In the embodiments described here, the fluid can always enter into the swirl chamber 17 from the ring passage 33 via one or more relief openings independently of the axial position of the stopper 25. The embodiments described here each show two relief openings offset by 180° in the peripheral direction with respect to one another, and indeed an axially aligned relief bore 29 and a relief cut-out 31 which is, for example, produced by milling and is open radially outwardly, i.e. the cut-out 31 is an incision at the front marginal region of the stopper 25.

Figure 2A:
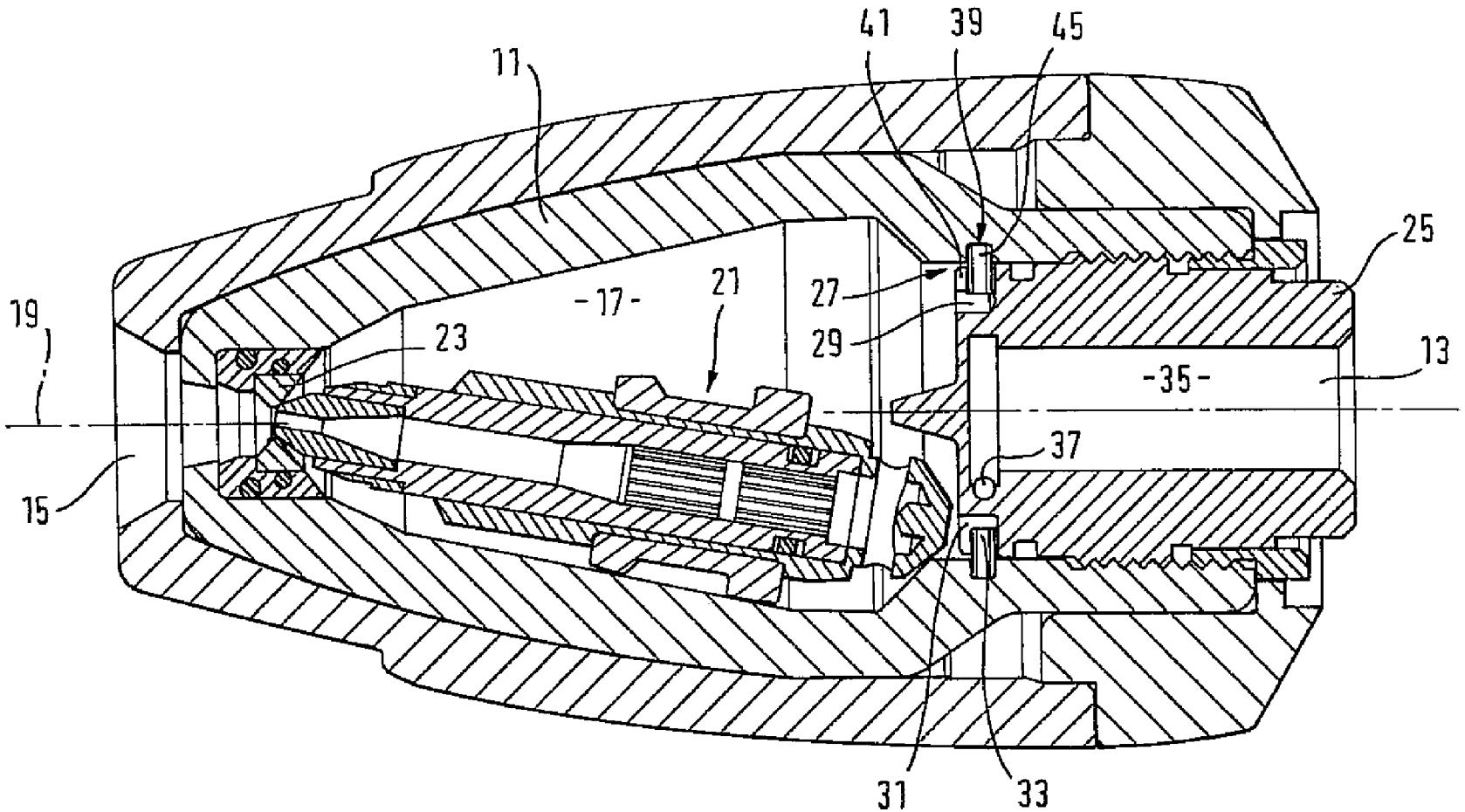
FIGS. 2*a* and 2*b* a further embodiment of a rotor nozzle in accordance with the invention in two different operating positions.
Figure 3A:
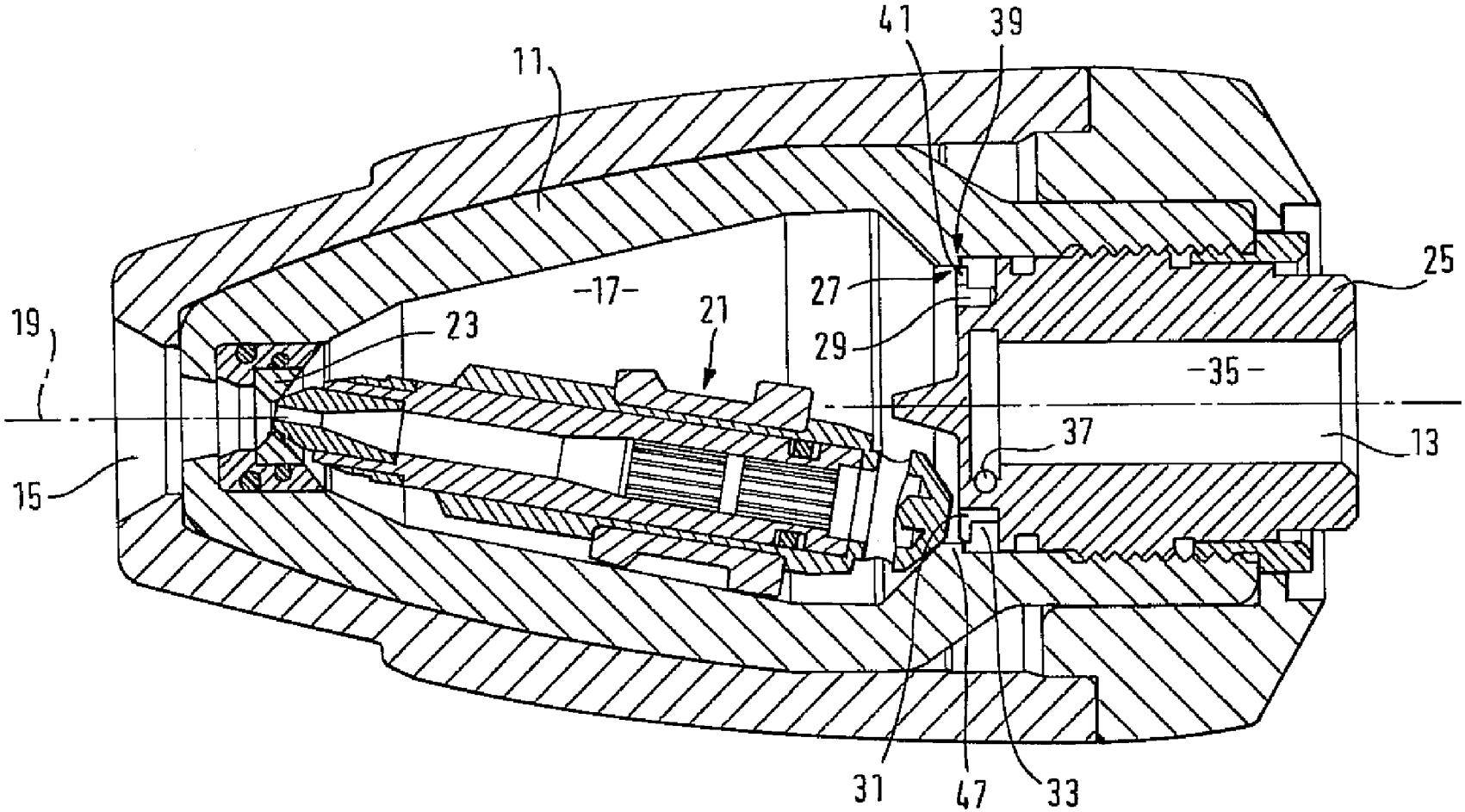
FIGS. 3*a* and 3*b* a further embodiment of a rotor nozzle in accordance with the invention in two different operating positions.

The relief cross-section, i.e. the sum of the flow cross-sections of all relief openings 29, 31 is selected such that it is larger than the cross-section of the drive bore 37 so that the drive bore 37—seen in a technical flow aspect—so-to-say forms the "bottleneck" and there is also no pressure difference between the bring passage 33 and the swirl chamber 17 when—as in the positions in accordance with FIGS. 1*a*, 2*a* and 3*a*—the relief openings 29, 31 form the only path for the fluid from the ring passage 33 into the swirl chamber 17.

The already mentioned cam profile 39 at the inner wall of the nozzle housing 11 in the region of the ring passage 33 of the stopper 25 cooperates with a cam profile 41 of the stopper 25, with the cam profile 41 of the stopper 25 being formed by a front cam edge in these embodiments.

In the closed position in accordance with FIGS. 1*a*, 2*a* and 3*a*, the cam edge 41 contacts the inner wall of the nozzle housing 11 in a practically sealing manner. The stopper 25 and the nozzle housing 11 are worked to fit here. In this closed position, a transition of the fluid forming the rotating fluid field in the ring passage 33 into the swirl chamber 17 radially outwardly past the cam edge 41, i.e. between the stopper 25 and the inner wall of the nozzle housing 11, is not possible. Only the relief openings 29, 31 are available for the fluid. The fluid circulating in the ring passage 33 is consequently forced to make a change of direction, i.e. a flow deflection, which disrupts or destroys the rotating fluid field when flowing through the relief openings 29, 31.

The extent of the disruption of the rotating fluid field can—as experiments have shown—be influenced by the configuration and arrangement of the relief means 29, 31. In the embodiments shown, the relief openings 29, 31 are oriented such that the fluid flows into the swirl chamber 17 substantially in the axial direction. Experiments have shown that even a slight inclination of the relief bore 29 relative to the longitudinal axis 19 has the consequence that the rotating fluid field is maintained to a relevant degree on the transition into the swirl chamber 17. A rotary operation with a swirl flow taking along the rotor 21 in the swirl chamber 17 can therefore also be achieved in the closed position, i.e. in a position in which the fluid can only move into the swirl chamber 17 via the relief means or relief openings, on a corresponding configuration of the relief means.

This means that an exceptional possibility is provided by the relief means to set the behavior of the rotor nozzle, and in particular the speed of the rotor 21, directly.

Figure 1B:
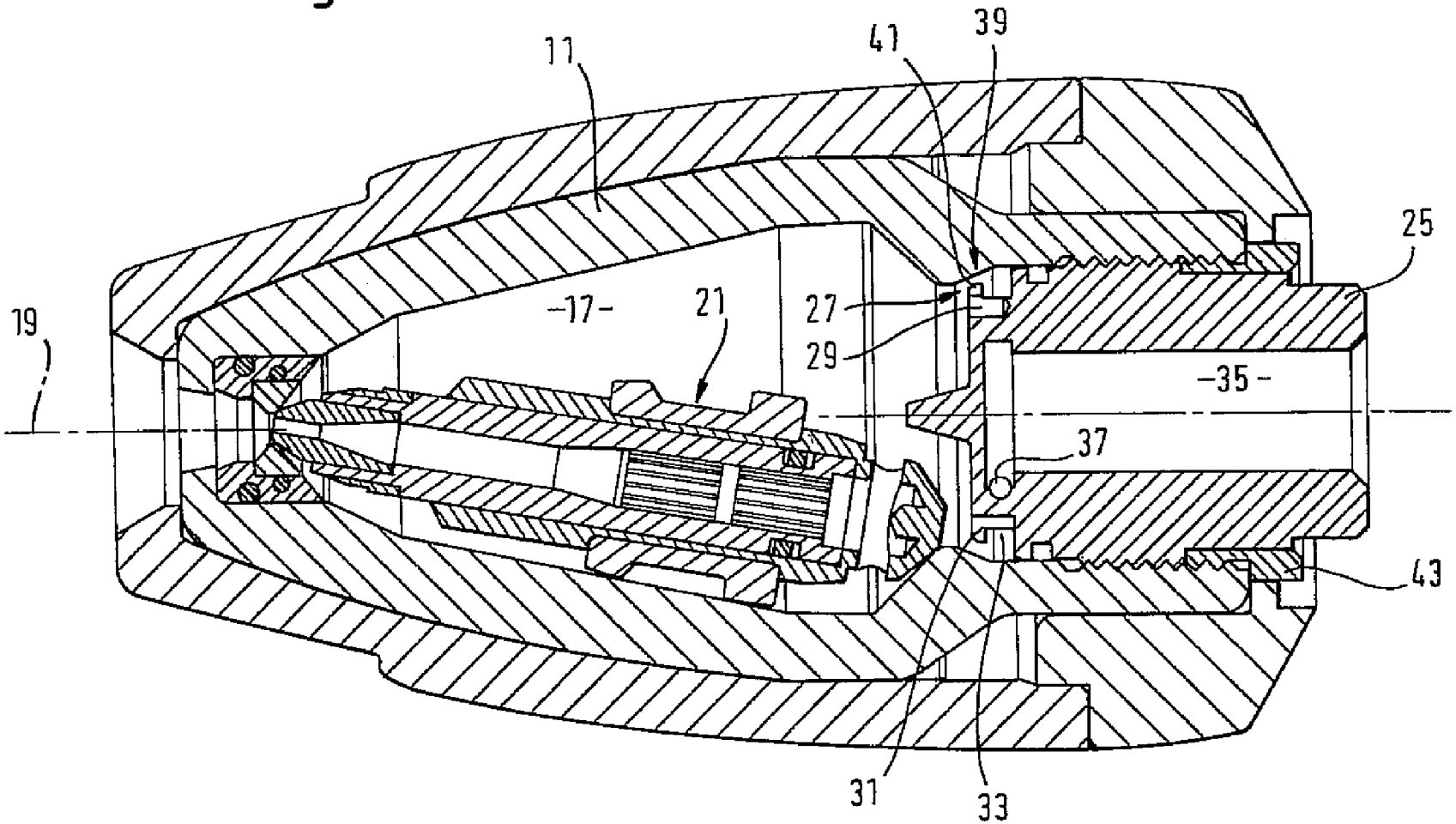

Just such a setting possibility is provided by the cooperation of the cam edge 41 of the stopper 25 and the cam profile 39 of the inner wall of the nozzle housing. As the comparison of FIGS. 1*a* and 1*b* shows, a passage which is not interrupted in the peripheral direction and which has the form of a ring gap 27 arises between the cam edge 41 and the inner wall of the nozzle housing 11 on the unscrewing of the stopper 25 from the nozzle housing 11, with the rotating fluid field being able to propagate or spread via said ring gap out of the ring passage 33 in an unimpeded manner in the axial direction into the swirl chamber 17 with respect to the peripheral direction. The size of the ring gap 27 and/or the rate of variation of the gap size on the adjustment of the stopper 25 relative to the nozzle housing 11 can be directly predetermined by the design of the cam profile 39 at the inner wall of the nozzle housing 11 and by a corresponding configuration of the cam edge 41 or of the corresponding region of the stopper 25.

In the embodiment of FIGS. 1*a* and 1*b*, the cam profile 39 of the inner wall of the nozzle housing 11 is configured as a cone converging axially forwardly, whereas the stopper 29 is made as a corresponding cone in its axially front region.

Figure 2B:
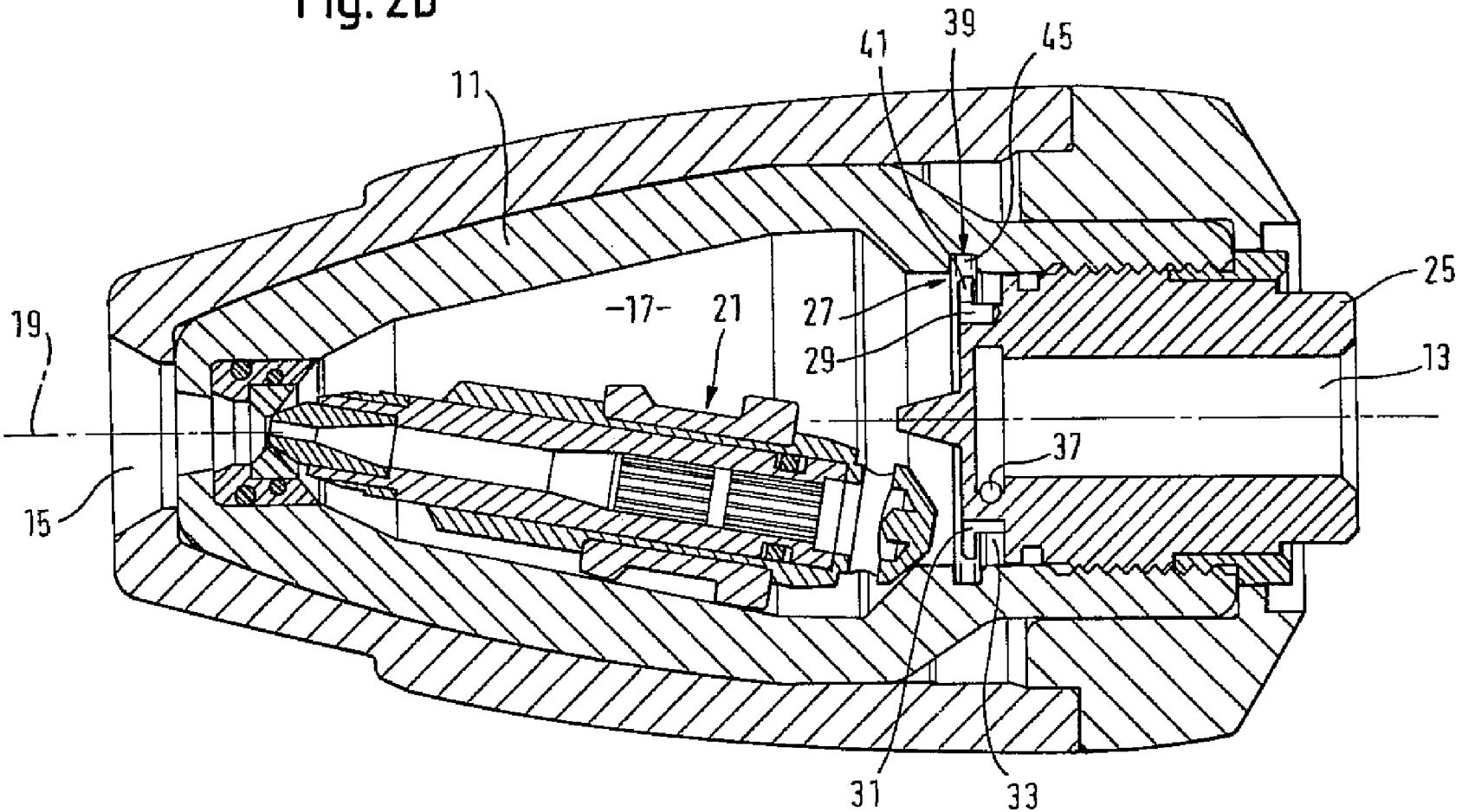

In the embodiment of FIGS. 2*a* and 2*b*, the inner wall of the nozzle housing 11 and the outer side of the stopper 25 are each made as cylindrically straight. The cam profile 39 of the nozzle housing 11 moreover includes a ring groove 45 which is formed in the cylinder wall and which is positioned in front of the cam edge 41 of the stopper 25 and coincides with the ring passage 33 with respect to the axial direction in the closed position in accordance with FIG. 2*a*. No ring gap is present between the cam edge 42 and the inner wall of the nozzle housing 11 in this closed position. This is different in the position in accordance with FIG. 2*b*. The cam edge 41 of the stopper 25 is located—with respect to the axial direction—in the region of the ring groove 45 of the nozzle housing 11 such that the fluid can flow out of the ring passage 33 radially outwardly around the cam edge 41 and can enter into the swirl chamber 17 while completely maintaining, or at least largely maintaining, the rotating fluid field.

Figure 3B:
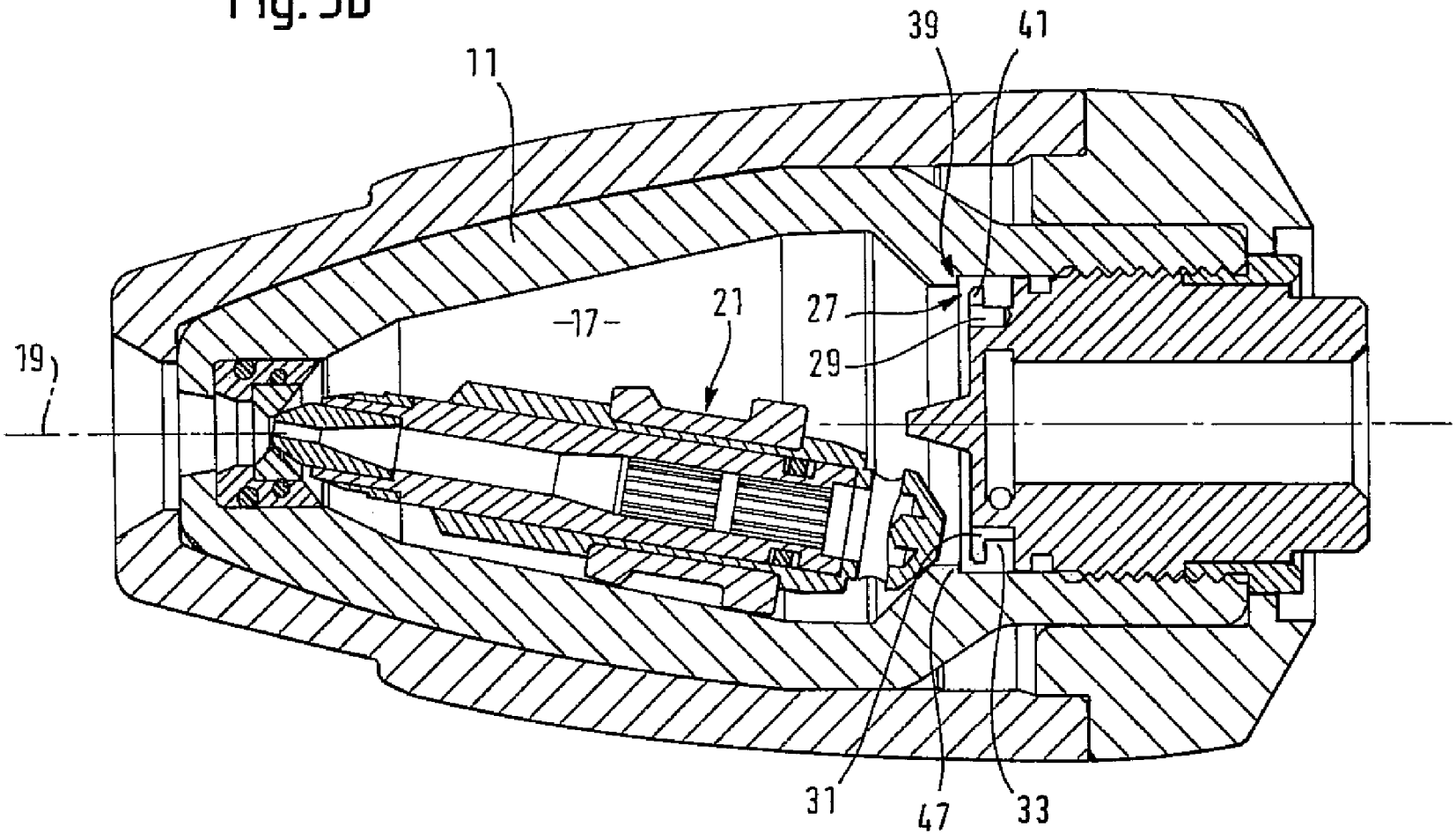

In the embodiment of FIGS. 3*a* and 3*b*, the inner wall of the nozzle housing 11 and the outer side of the stopper 25 are in turn made cylindrically straight, with the cam profile 39 of the nozzle housing 11, however, being formed by a radially inwardly projecting ring shoulder 47 in the front region.

The front cam edge 41 of the stopper 25 is made correspondingly rearwardly projecting so that the cam edge 41 contacts the ring shoulder 47 in the closed position in accordance with FIG. 3*a*, so that there is no ring gap at this point and so that the fluid forming the rotating fluid field in the ring passage 33 is thus forced to flow via the relief openings 29, 31 into the swirl chamber 17.

In the open position in accordance with FIG. 3*b*, in contrast, the cam edge 41 is radially spaced apart from the inner wall of the nozzle housing 11 so that a ring gap 27 is present around which fluid circulating in the ring passage 33 can flow while completely maintaining, or at least largely maintaining, the rotating fluid field in order to generate the swirl flow in the swirl chamber 17 providing the taking along of the rotor 21.

It was mentioned above that the cam edge 41 of the stopper 25 and the inner wall of the nozzle housing 11 can be worked to fit so that a practically complete seal of the ring passage 33 is provided in this region in the closed position. This cooperation region of the cam edge 41 and the inner wall of the nozzle housing can, however, generally be varied as desired. In the closed position, for example, a ring gap having a specific size could thus also be allowed, whereby a specific portion of the fluid can move into the swirl chamber 17 while maintaining the rotating fluid field. Furthermore, the control cam 41 or the inner wall of the nozzle housing 11 can also be made in knurled form. Further relief possibilities can hereby be provided.

The invention claimed is:

1. A rotor nozzle, in particular for high pressure cleaning devices, having a nozzle housing (11) which has a swirl chamber (17) between an inflow opening (13) for a fluid, in particular water, and a discharge opening (15), with a rotor (21) inclined with respect to a longitudinal axis (19) during operation being supported at its front end at a bearing (23), in particular at a cup-shaped bearing, in said swirl chamber and with the rotor being able to be driven to make a rotating movement around the longitudinal axis (19) by fluid flowing into the swirl chamber (17), characterized in that an adjustment device (25) is positioned in front of the swirl chamber (17) for the speed regulation of the rotor (21) and forces the inflowing fluid to make a rotating movement around the longitudinal axis (19) for the generation of a rotating fluid field before the transition into the swirl chamber (17); and in that the rotating fluid field is disrupted more or less pronouncedly on the transition into the swirl chamber (17) in dependence on the position of the adjustment device (25);

wherein the adjustment device is configured as a stopper (25) which can be screwed into the nozzle housing (11), to which a fluid supply line can be connected and which has an inflow space (35) into which the supplied fluid first moves and from which the fluid then moves via a drive bore (37), in particular a drive bore oriented radially or tangentially to the longitudinal axis, into a ring passage (33) for the generation of the rotating fluid field.

2. A rotor nozzle in accordance with claim 1, characterized in that a compulsory deflection of the fluid flow is provided for the disruption of the rotating fluid field.

3. A rotor nozzle in accordance with claim 1, characterized in that the transition into the swirl chamber (17) is formed by a ring passage (27), in particular a gap-shaped ring passage, and a relief opening (29, 31).

4. A rotor nozzle in accordance with claim 1, characterized in that the size of the ring passage (27) is adjustable.

5. A rotor nozzle in accordance with claim 1, characterized in that at least one ring passage (33) for the inflowing fluid is provided for the generation of the rotating fluid field before the transition into the swirl chamber (17).

6. A rotor nozzle in accordance with claim 5, characterized in that the ring passage (33) is bounded by the adjustment device (25) and the inner wall of the nozzle housing (11).

7. A rotor nozzle in accordance with claim 1, characterized in that the adjustment device (25) and the inner wail of the nozzle housing (11) have cooperating cam profiles (39, 41) which can be moved relative to one another by adjustment of the adjustment device (25) either to enlarge or reduce a ring passage (27) disposed after the ring passage (33).

8. A rotor nozzle in accordance with claim 1, characterized in that the adjustment device (25) can be screwed into the nozzle housing (11) and the speed of the rotor (21) can be regulated by varying the screw-in depth of the adjustment device (25).

* * * * *